United States Patent [19]

Chen

[11] Patent Number: 5,052,453

[45] Date of Patent: Oct. 1, 1991

[54] STRUCTURE OF PENCIL SHARPENER

[76] Inventor: Geoffery Chen, 9F/5, No. 16, Nanking East Road, Sec. 5, Taipei, Taiwan

[21] Appl. No.: 617,708

[22] Filed: Nov. 26, 1990

[51] Int. Cl.[5] ..... B43L 23/02

[52] U.S. Cl. ..... 144/28.5; 144/28.6; 144/28.72

[58] Field of Search ..... 144/28.1, 28.5, 28.6, 144/28.72, 28.4

[56] References Cited

U.S. PATENT DOCUMENTS

| | | | |
|---|---|---|---|
| 2,408,767 | 10/1946 | Fleming | 144/28.5 |
| 2,561,438 | 7/1951 | Duchesneau | 144/28.5 |
| 3,678,975 | 7/1972 | Imanishi et al. | 144/28.5 |
| 3,746,061 | 7/1973 | Nakazaki | 144/28.5 |

*Primary Examiner*—W. Donald Bray

*Attorney, Agent, or Firm*—Lowe, Price, LeBlanc & Becker

[57] ABSTRACT

A pencil sharpener, comprising an audio circuit reporter which gives audio signal to report that pencil has been well sharpened. The audio circuit reporter is comprised of an audio circuit, a dry battery and a speaker. The two opposite terminal ends of the audio circuit are respectively connected to two electric contacts which are electrically connected by the protruding pencil lead of the pencil which is well sharpened in the pencil sharpener, so that the audio circuit gives an audio signal through the speaker to report that the pencil which is inserted in the pencil sharpener has been well sharpened.

1 Claim, 1 Drawing Sheet

STRUCTURE OF PENCIL SHARPENER

BACKGROUND OF THE INVENTION

The present invention relates to pencil sharpeners, and more particularly to a pencil sharpener which utilizes an audio circuit reporter to give an audio signal when the pencil which is inserted therein is well sharpened.

When using a conventional pencil sharpener, either of hand operated or motorized type, one can not accurately estimate when a pencil is to be well sharpened after it is inserted in a pencil sharpener. It is quite often necessary to repeatedly insert a pencil in a pencil sharpener for sharpening, each time a pencil is to be sharpened, because one can not make sure when a pencil is well sharpened. A pencil may have to be inserted in a pencil sharpener for sharpening again if a pencil is not well sharpened. If a pencil is sharpened excessively, much pencil lead will be wasted.

SUMMARY OF THE INVENTION

The present invention has been accomplished to eliminate the aforesaid problems. It is therefore the object of the present invention to provide a pencil sharpener which can produce a signal to tell an user when a pencil has been well sharpened.

According to the present invention, a pencil sharpener comprises a reporter to advise an user to stop the sharpener when a pencil which is inserted therein has been well sharpened. The reporter can be an audio circuit reporter comprised of an audio circuit, a dry battery and a speaker. The audio circuit is electrically connected by the protruding pencil lead of the pencil sharpened by the present pencil sharpener, to provide an audio signal through the speaker. The reporter can also be a video circuit reporter which gives a video signal when a pencil which is inserted therein has been well sharpened.

BRIEF DESCRIPTION OF THE DRAWING

Embodiment of structure of pencil sharpener according to the present invention will now be described by way of example, with reference to the annexed drawing, in which.

DETAILED DESCRIPTION OF THE PREFERRED EMBODIMENT

Figure 1:
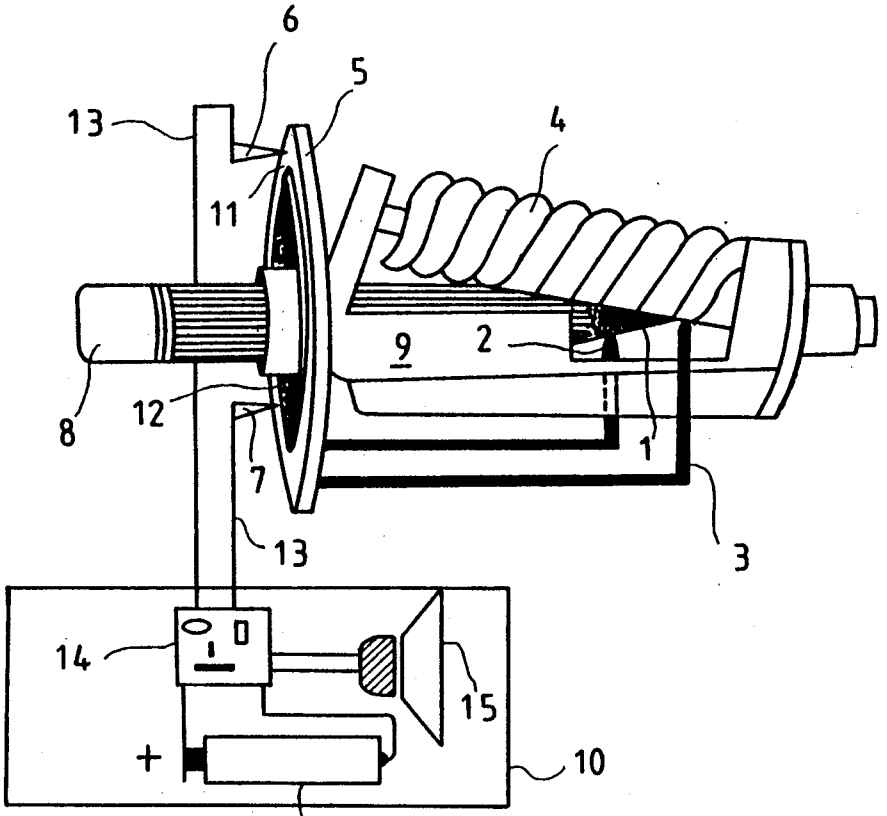
FIG. 1 is a schematic structural view of the preferred embodiment of the present invention.

Referring to FIG. 1, a pencil sharpener in accordance with the present invention is generally comprised of rotary cutter 4, swivel cutter holder 9, strip conductors 2, 3, conductive ring 5, circular plate conductor 12, conductive brushes 6, 7, wire conductors 13, and reporter 10.

As illustrated, two strip conductors 2, 3 are respectively mounted on a swivel cutter holder 9 which is controlled to carry a rotary cutter 4 for whittling pencil. When a pencil is well sharpened in the pencil sharpener, the first strip conductor 2 is in contact with the root portion of the protruding pencil lead 1, and the second strip conductor 3 is in contact with the tip of the protruding pencil lead 1. There is a conductive ring 5 mounted on the swivel cutter holder 9 at the front, which has a ring-shaped conductive surface 11 connected to the second strip conductor 3. There is also provided a circular plate conductor 12 disposed between the center of the conductive ring 5 and the ring-shaped conductive surface 11. The circular plate conductor 12 is insulated from the ring-shaped conductive surface 11 and connected to the first strip conductor 2. Two conductive brushes 6, 7 which are made of wear-proof, conductive material are fixedly secured to the frame structure of the pencil sharpener and respectively disposed in contact with the ring-shaped conductive surface 11 and the circular plate conductor 12 for conducting electric current. The two conductive brushes 67 are respectively connected to a reporter 10 through wire conductors 13. A reporter 10 may be an audio or video alarm which gives an audio or video signal when it is triggered. In the present preferred embodiment, a reporter 10 is an audio alarm comprised of an audio circuit 14, a sperker 15 and a dry battery 16.

The operation of the present invention is outlined hereinafter. Turn on the pencil sharpener after a pencil 8 is inserted into position. If the pencil lead 1 is still under whittling, the front tip of the pencil lead 1 does not touch the second strip conductor 3, and the reporter 10 is off. As soon as the pencil lead 1 is well sharpened, the front tip of the pencil lead 1 becomes in contact with the second strip conductor 3 to electrically connect the second strip conductor 3 to the first strip conductor 2, which is in contact with the root portion of the protruding pencil lead 1, to incorporate with the reporter 10 into a closed circuit, therefore, the audio circuit 14 is triggered to produce an audio signal through the speaker 15, telling an user that the pencil 8 has been well sharpened.

What is claimed is:

1. A pencil sharpener, comprising a swivel cutter holder having a rotary cutter for whittling a pencil, two electric contacts at one end and spaced from each other, a conductive ring at an opposite end, said conductive ring having a ring-shaped conductive surface at one side and connected to either one of said two electric contacts, a circular plate conductor fastened in said cutter holder, insulated from said ring-shaped conductive surface and connected to the other electric contact, two conductive brushes fixedly secured to the frame structure of the pencil sharpener and having each an end respectively disposed in contact with said ring-shaped conductive surface and said circular plate conductor, and an opposite end respectively connected to an alarm and characterized in that said two electric contacts are electrically connected by the protruding pencil lead of the pencil when inserted in said swivel cutter holder and sharpened by said rotary cutter, to trigger said alarm to produce an alarm signal.

* * * * *